United States Patent [19]

Quantin et al.

[11] Patent Number: 4,801,338

[45] Date of Patent: Jan. 31, 1989

[54] PROCESS OF PROTECTIVE COATING OF IRON AND STEEL PRODUCTS

[75] Inventors: Danièle Quantin, Nogent s/Marne; Francisco Galdon, Nanterre, both of France

[73] Assignee: Institut De Recherches de la Siderurgie (IRSID), Maizieres-les-Metz, France

[21] Appl. No.: 11,538

[22] Filed: Feb. 6, 1987

[30] Foreign Application Priority Data

Feb. 6, 1986 [FR] France ..... 86 01636

[51] Int. Cl.[4] ..... C23C 22/00

[52] U.S. Cl. ..... 148/6.14; 427/433

[58] Field of Search ..... 148/6.14; 427/433

[56] References Cited

U.S. PATENT DOCUMENTS

| | | | |
|---|---|---|---|
| 3,085,034 | 4/1963 | Croessant et al. | 148/6.11 |
| 3,925,579 | 12/1975 | Flinchun et al. | 427/433 |
| 4,214,015 | 7/1980 | Stephan | 427/319 |
| 4,297,398 | 10/1981 | Paulus | 427/319 |
| 4,425,383 | 1/1984 | Abatura | 427/327 |

FOREIGN PATENT DOCUMENTS

| | | | |
|---|---|---|---|
| 2340413 | 2/1974 | Fed. Rep. of Germany | 427/433 |
| 1055872 | 2/1954 | France . | |
| 1360754 | 3/1963 | France . | |
| 2029285 | 10/1970 | France . | |
| 2345266 | 10/1977 | France . | |
| 1153202 | 5/1969 | United Kingdom . | |

OTHER PUBLICATIONS

Review of Current Literature on the Paint and Allied Industries, vol. 22, No. 129, May, Jun. 1949, p. 265, The Paint Research Association, Teddington, GB; H. Ketterl: "Rust Layers as Adhesion-Promoting Surfaces for Painting"; Abstract.

Patent Abstracts of Japan, vol. 3, No. 157 (C-68), Dec. 22, 1979, p. 79 regarding JP-A-54 133 438 (Shin Nippon Seitetsu K.K.) 17-10-1979.

French Search Report.

*Primary Examiner*—Thurman K. Page

*Assistant Examiner*—L. R. Horne

*Attorney, Agent, or Firm*—Staas & Halsey

[57] ABSTRACT

A process of protective coating of iron and steel products is described, wherein an adherent and rough layer of scale is formed, on which is directly deposited a layer of a protective material. The qualities of the layer of scale result from the fact that the product is shaped hot and the speed of its cooling is controlled so that the resultant thickness of scale is less than a threshold of adherence characteristic of the material and of the temperature at the end of shaping. The layer of protective material is obtained by metallization with zinc or an alloy based on zinc. The invention is principally applicable to long iron and steel products, and in particular to reinforcing bars for concrete.

3 Claims, 1 Drawing Sheet

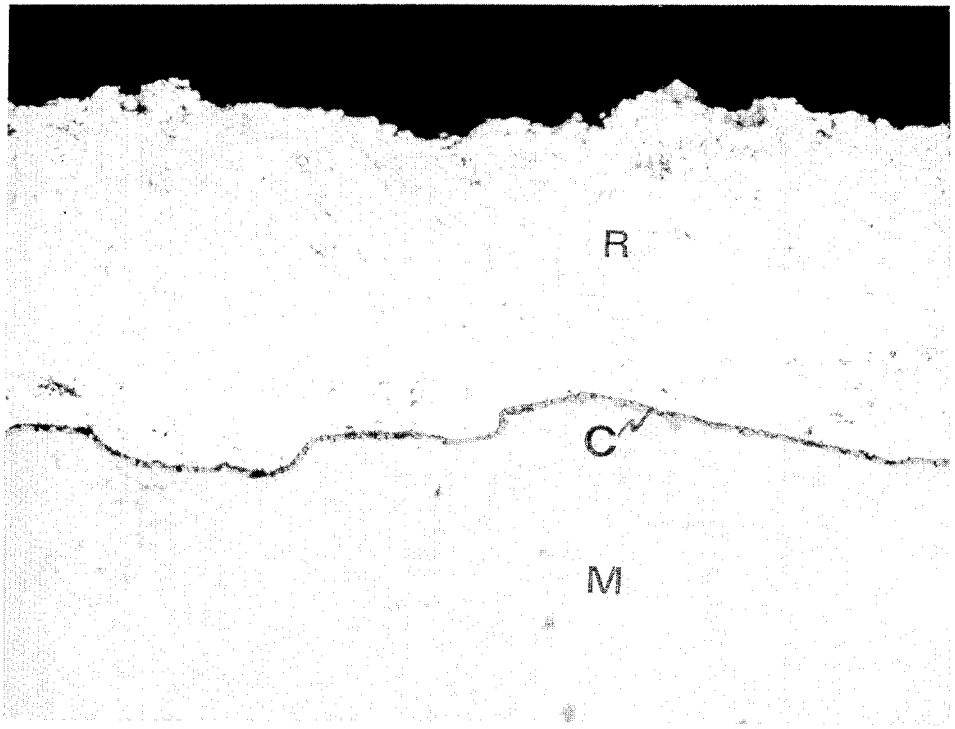
FIG. 1
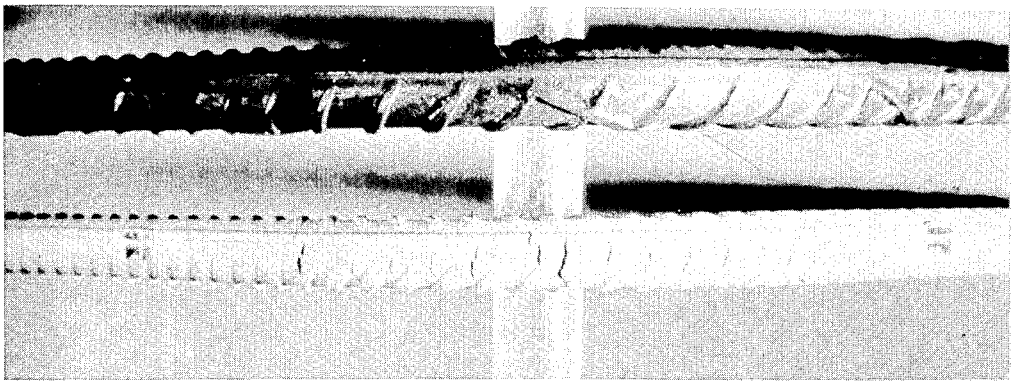
FIG. 2a
FIG. 2b
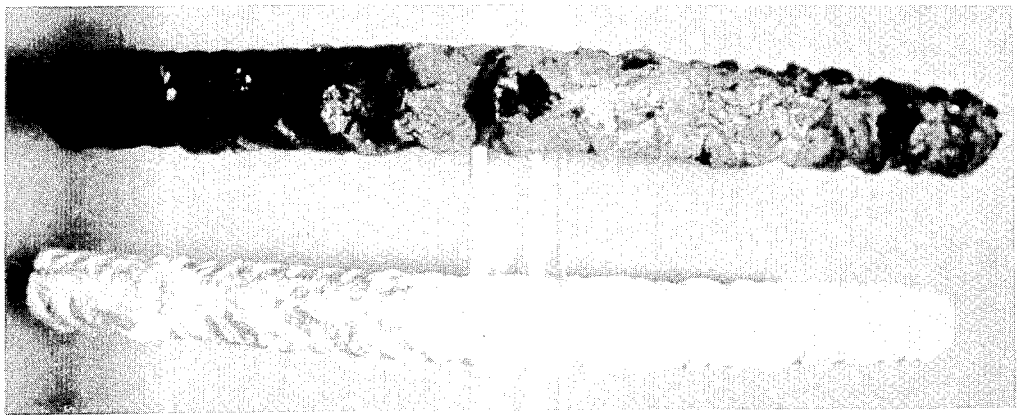
FIG. 3a
FIG. 3b

PROCESS OF PROTECTIVE COATING OF IRON AND STEEL PRODUCTS

BACKGROUND OF THE INVENTION

The present invention relates to the protection of the surface of iron and steel products shaped at a relatively high temperature.

A preferred application of the invention concerns long products and, in typical, but non-limiting manner, the protection of reinforcing bars, hereinafter referred to as rebars.

The temperature at the end of working off of the rebars leaving the finishing stands of the rolling mills is usually of the order of 900 to 1000° C. The rebars are then cooled, placed in readiness, then taken up to be cut to length.

In current practice, the rebars are not considered as noble products and do not undergo any protection treatment.

However, an increasing need for rebars protected against corrosion is observed at present. For certain markets where storage in the open air lasts a long time (e.g. six months) and takes place in a relatively corrosive atmosphere such as that of a port, an at least temporary protection of the rebars is desirable. In other cases, a better resistance to corrosion in service is demanded of the rebars used in works made of a particular concrete, of which certain constituents are more particularly liable to corrosion, or made in a relatively aggressive environment. In those cases, a protection of long duration is desirable.

To respond to this increasing need, it is necessary to find an efficient and economically acceptable process of protection. This latter criterion is all the more strict as the market value of rebars per se is very low.

The solution, which has been proposed, of making the rebars from stainless steel, entirely or plated therewith, can thus not be generalized due to its cost.

The processes known to the man skilled in the art for protecting the iron have, up to the present time, not found a commercially advantageous application for rebars, as they all require a step for preliminary preparation of the product in order to remove the scale and other oxides developed on the surface during cooling of the product, during manufacture thereof.

In this way, hot galvanizing requires, apart from exceptions (JP-A-54/133438), a prior pickling of the rebar with acid, as the scale forms a barrier to the reaction of galvanizing. The scale also opposes an electrolytic deposit or the application of a film-forming material, preceded by the formation of a layer of finish, either by heat treatment (US-A-3 085 034) or by reaction of the bare surface with an acid solution of metal sulfates (GB-A-1 153 202) or with vapor (Review of Current Literature on the Paint and Allied Industries, Vol. 22, No. 129, May-June 1949, page 265).

Similarly, metallization by spraying (called "schoopage"), in particular metallization with zinc, is known to the man skilled in the art to require pickling, by sandblasting or shot-blasting, of the surface to be treated (cf. Techniques de l'Ingénieur", M1641-4, para. 3,6; "La Métallisation du zinc", page 5, para. 5 and 13, para. 9, published by the "Centre Technique du Zinc)". It is therefore systematically sought to obtain on the unworked product scale which adheres the least possible in order to facilitate removal thereof. Now, such pickling requires that the rebars produced be taken up individually or in very small groups, this therefore considerably increasing the cost of the treated rebars.

Similar drawbacks encumber the process disclosed by FR-A-2 029 285 according to which there is applied to the surface to be protected, which is still very hot, a metal borate which brings about a reaction of dissolution of the scale, which produces a brittle layer which must be subsequently detached by a mechanical means.

SUMMARY OF THE INVENTION

It is an object of the invention to propose a process of protective coating of iron and steel products, which is efficient and economical and/ does not suffer from the drawbacks mentioned above.

This object is attained by the invention by working off the product hot and monitoring the speed of accelerated cooling thereof so that the resulting thickness of scale which is naturally formed on the surface is less than the threshold of adherence, characteristic of the metal of which the product is made and of its temperature at the end of working off, and a protecting material is then deposited directly on the layer of scale thus formed. In a large number of applications (particularly for rebars), the cooling of the product after it has been formed is controlled so that the mean thickness of the layer of scale formed during cooling does not exceed about 8 μm.

In its most general sense, the expression "hot" denotes the temperatures, known by the man skilled in the art, which bring about the rapid formation of a layer of scale.

The invention goes against the firmly established idea for the man skilled in the art that the scale which is formed naturally during working off of the hot product is absolutely incompatible with the adherence of a superficial layer of protective material. In fact, it has been surprizingly found that, according to the invention, when the formation of the scale is controlled, this layer may present characteristics (of adherence and of roughness in particular) which make it possible to apply directly thereon (i.e. without pickling, but without excessive waiting time which would degrade the surface)a perfectly adherent protective coating.

It will be understood that, according to the invention, the protective coating is a layer of a material to form a barrier between the metal surface, coated with scale, and the atmosphere (without intervention of a chemical reaction between said material and the scale, contrary to FR-A-2 029 285 mentioned above).

Control of the formation of the scale passes, according to the invention, through the control of the cooling: a rapid cooling (by immersion in water, for example) is particularly favorable as it avoids maintaining the metal surface too long at a relatively high temperature propitious to the rapid development of the scale.

In present practice, control of cooling is often easier with long products, especially of relatively small section, than with flat products. In this respect, the invention finds particularly advantageous application in installations for producing rebars where an accelerated cooling device already exists. In the system known under the name of TORSID ®, the rebar is immersed through a water jacket, advancing in a cooling tube. A subsequent natural reheating from the heart leaves the product surface at 400°-500° C. on leaving the rolling train. The bars are cut hot and disposed laterally on an air cooling table allowing the temperature to go down to substantially ambient temperature, with a view to being taken up for cutting to exact length and exit from the installation. On the cooling table, the fresh scale which covers the rebars (with a mean thickness of 2 to 3 μm) allows direct coating by a layer of protective material.

The coating is advantageously a metallization with zinc by spraying, as this technique may be carried out within a wide range of temperatures, which makes it possible to treat the rebars at any stage of their cooling on the cooling table.

It will be understood that, carried out in this way, the process according to the invention is all the more economical as, not only does it avoid the descaling step, but it is locally included in a generally non-encumbered zone of the installation and in a passive phase of the process of cooling of the rebars.

The mean thickness of the zinc coating is advantageously of the order of 20 to 40 μm, in order to ensure a sufficient protection. A much larger thickness may lead, in the case of bending of the coated rebar, to a cracking of the coating. However, it should be noted that, even if cracked, the zinc coating ensures a protection (this time of the sacrificial type).

On the rebars, the zinc may be replaced by alloys of zinc and of aluminium (the latter in a proportion of up to 20%) which are easier to apply and having a better resistance. The preferred alloy is the Dunois alloy (90% Zn—10% Al).

Without wishing to limit the invention by theoretical explanations, it would, however, appear that it is based on the following considerations.

The behaviour of the protective coating directly applied on the scale is determined by the adherence of the scale and the quality of its surface.

The notion of adherence covers two aspects: the adherence before application of the protective coating which is associated with the adherence of the layer of oxide in the course of its growth, during the accelerated cooling of the unworked product, and the adherence during forming of the coated product which is associated with the aptitude to deformation of the oxides in the course of a mechanical deformation of the coated product (for example by bending the ends of the rebars).

As far as the first aspect is concerned, the formation of oxide occurs with increase in volume (×1.7 to 2) with respect to the metal which produced it. Therefore, at the metal/scale interface, the oxide is in compression and the metal in traction. All these accumulated stresses are absorbed without rupture for thin scale (of some micrometers), all the more so as the structure of the oxides is so-called decomposed (accelerated cooling to about 600°–550° C. then decelerated cooling to ambient temperature - but in an only slightly oxidizing atmosphere in general). For thick scale (greater than about 10 μm), the stresses are absorbed by ruptures of the oxides and detachments at the interface. Therefore, without outside mechanical stresses for simple reasons of growth, a scale, in order to be nondegraded, must be thin (some μm). In general, up to about 6–8 μm, no rupture is observed.

Concerning the second aspect, there are two modes of rupture for the scale: one rupture by cracking perpendicular to the metal-oxide interface without loss of adherence, therefore acceptable, and one rupture by separations of scales of oxide, which is inadmissible. The boundary between the two modes is a limiting thickness of oxide which depends:

on the temperature of formation of the oxide: at 900° C., the limiting thickness is between 8 and 13 μm depending on the surface state at the start, whilst, at 750° C., the limiting thickness is between 18 and 30 μm;

on the roughness of the surface before oxidation: at 800° C., on a polished surface, the limiting thickness is about 10 μm, whilst, on an unworked surface (rough), this limiting thickness is about 18 μm;

and also on the structure of the oxides, as for the decomposed oxides, the limiting thickness increases.

For the metal coating not to be detached with the oxide in the course of a deformation, its thickness must be less than a limiting value, to which a figure has never been given, during experiments on rebars, below 8 μm.

In order to be adapted to be coated with the protective material, the surface of the scale must be rough, clean and regular. These qualities depend most often on the steps of preliminary shaping of the product. In the case of long products (and in particular of rebars), the surface roughness after shaping in the mill trains, is generally considerable (very often much greater than that of the flat products which require a more careful surface quality). Cleanness and regularity of the surface are then ensured if the positioning of the coating takes place, according to the invention, directly on the oxide which has just been formed, without unnecessary waiting.

Furthermore, these two aspects covered by the notion of adherence of the scale are conveniently characterized by a "threshold of adherence", representative of the nature of the metal of which the product is made and of its temperature at the end of working off hot (end of rolling in general) corresponding to the beginning of formation of the scale which it is desired to conserve on the product. In this way, this threshold of adherence is defined as the maximum value of the thickness of scale which simultaneously satisfies these two aspects, therefore the most strict of the two. In the present case, it is the one relative to the adherence of the scale in the course of formation on an unworked straight product and of which said maximum value attains about 8 μm.

BRIEF DESCRIPTION OF THE DRAWINGS

By way of illustration, the tests and examinations described hereinafter with reference to the accompanying photographs, were carried out.

In these photographs:

FIG. 1 is a partial micrographic section, enlarged 500 times, of a rebar coated according to the invention.

FIGS. 2*a* and 2*b* are views of rebars, respectively bare, i.e. covered with scale formed according to the invention, and coated with a protective material (zinc).

FIGS. 3*a* and 3*b* are views corresponding to FIGS. 2*a* and 2*b* showing the same rebars but after exposure for 400 hrs. to an atmosphere of salt spray fog.

DETAILED DESCRIPTION OF THE PREFERRED EMBODIMENTS

Examination No. 1 (FIGS. 1 and 2*a*)

The thickness of scale "c" formed according to the invention on rebars "M" obtained by the "TORSID" process is measured. The mean thickness is from 1 to 2 μm, with, very locally, excess thicknesses that may attain 12 μm. Micrographies have confirmed that the layer of oxide is very adherent and that the appearance of the outer surface is uneven, with considerable roughness.

TEST No. 1 (FIGS. 1 and 2*b*)

The rebars previously examined (diameter 8 mm) were metallized with zinc by spray gun. One series of samples received a coating "R" with a mean thickness of 60 μm. A second series received a coating with a mean thickness of 200 μm. Some irregularities in thickness due to the presence of the ribs present in relief on the surface, were observed.

The appearance of the products obtained shows that the adherence of the zinc is very good.

EXAMINATION No. 2 (FIG. 1)

Micrographies of the rebars of Test 1 have shown an excellent penetration of the zinc R in all the anfractuosities of the scale "c" and of the surface of the metal M; a very good adherence of the coating on the scale; a very good compactness of the coating and a very rough outer appearance, enabling a good catching with the concrete.

Test No. 2 (FIGS. 3*a* and 3*b*)

The rebars of test 1 were tested in a salt spray fog under the following standardized conditions: temperature of 35° C. and water with 5% NaCl (50 g/l).

It was observed that the first rust appeared only after about 8 days for the thin coatings (60 μm) and after 15 days for the thick coatings (200 μm).

TEST No. 3 (FIGS. 2*a* and 2*b*)

Rebars with a diameter of 10 mm were coated with zinc for some (FIG. 2*b*) and with "Dunois" alloy for the others, in mean thicknesses of 75, 90, 100 and 150 μm. Non-coated control rebars were also conserved (FIG. 2*a*). Their aptitude to fashioning by bending was tested, by bending them slowly to 90° about a mandrel having a diameter triple that of the rebars.

A considerable cracking of the layer of coating was noted, probably due to too large a thickness.

TEST No. 4 (FIG. 3*a* and 3*b*)

The rebars of the preceding test were tested for 400 hrs. in a salt spray fog enclosure. It was observed that non-coated control rebars degraded virtually immediately (FIG. 3*a*).

For the same thickness of coating, the rebars coated with the Dunois alloy resisted better than those coated with pure zinc (FIG. 3*b*).

The fashioned rebars and the straight (nonfashioned) rebars present, for a coating of the same nature, similar behaviour in a salt spray fog; in particular, no appearance of rust is observed at the level of the scaled zone of the fashioned rebars (sacrificial protection).

The embodiment described hereinabove is the preferred one. However, as an alternative, other types of coating may be provided. For example, an epoxy paint may be used and advantage may be taken of the heat of the rebars not yet completely cooled (temperature of about 200°-250° C.) to effect rapid auto-crosslinking of the paint (sprayed in thermosetting powder by means of a gun). Such a coating, for example in a layer of 200μm, makes it possible to obtain an excellent protection against the salt spray fog for straight rebars. On the other hand, if cracks are produced during bending of these coated rebars, no sacrificial protection is to be expected.

It would be useful to recall that no confusion should be made between the scale which is formed naturally in the course of the process of working off hot of a metallurgical product and the rust which is formed cold in a damp atmosphere on a product in the course of use. Scale, of dark colour, is essentially formed by iron oxide in the ferrous state, whilst rust, of reddish colour, is essentially formed by iron hydroxides, the iron being in the ferric state, and constitutes on the product a brittle layer which does not present any significant mechanical consistency.

What is claimed is:

1. Process of protective coating of an elongated steel product rolled hot, comprising the following steps:

(a) provoking, in ambient atmosphere the formation of an adherent and rough layer of scale at the end of working off of the product by controlled accelerated cooling from a temperature of about 900° to 1000° at the end of rolling to a temperature of about 550°-600° C. so that the resultant thickness of scale is less than a threshold characterized by the metal of which the product is made and of its temperature at the end of rolling, and then (b) depositing directly on the layer of scale thus formed a protective material.

2. The process of claim 1, wherein the deposit of protective material is effected by metallization with zinc or an alloy based on zinc.

3. The process of claim 1, wherein the steel product is a reinforcement bar cooled by immersion, then in the open air on a cooling table, and the layer of protective material is coated during the phase of cooling in air.

* * * * *